United States Patent [19]

Zorrilla et al.

[11] 4,202,310

[45] May 13, 1980

[54] ANTI-CORROSIVE POLYMERIC COATING

[76] Inventors: Fermin Zorrilla, 6210 Maynada St., Coral Gables, Fla. 33146; Agustin M. Alonso, 5471 W. 10th Ave., Hialeah, Fla. 33012

[21] Appl. No.: 841,476

[22] Filed: Oct. 12, 1977

[51] Int. Cl.[2] ..... F02F 1/12

[52] U.S. Cl. ..... 123/191 A; 123/41.84; 123/193 C; 428/36

[58] Field of Search ..... 123/41.72, 41.83, 41.84, 123/193 C, 193 CP, 193 CH, 191 A; 428/36; 92/144, 171

[56] References Cited

U.S. PATENT DOCUMENTS

| | | | |
|---|---|---|---|
| 2,879,116 | 3/1959 | Goetze | 123/41.84 |
| 3,219,516 | 11/1965 | Cobbledick | 428/36 |
| 3,967,020 | 6/1976 | Uemura et al. | 428/36 |
| 3,996,913 | 12/1976 | Hamparian | 123/41.83 |

FOREIGN PATENT DOCUMENTS

| | | | |
|---|---|---|---|
| 2037725 | 12/1970 | France | 123/191 A |
| 1464677 | 2/1977 | United Kingdom | 123/41.83 |

*Primary Examiner*—Charles J. Myhre
*Assistant Examiner*—Craig R. Feinberg
*Attorney, Agent, or Firm*—Clarence A. O'Brian; Harvey B. Jacobson

[57] ABSTRACT

An improved liner particularly useful for the prevention of pitting and corrosion of portions of an internal combustion engine, particularly a diesel engine, which contact a circulating coolant, the invention provides a coating over at least those portions of a "wet" cylinder block liner normally in contact with a coolant liquid, the coating being comprised of a polymerized resin, particularly the reaction product of a free radical catalyzed oxidatively coupled polyester resin. The polymeric coating of the invention is disposed over, conforms to, and adheres to those surfaces of a "wet" cylinder block liner normally in contact with a coolant liquid.

5 Claims, 2 Drawing Figures

ANTI-CORROSIVE POLYMERIC COATING

BACKGROUND OF THE INVENTION

1. Field of the Invention

The present invention relates to the inhibition and prevention of pitting and corrosion in cooling systems, particularly the pitting and corrosion of "wet" cylinder block sleeves or liners of internal combustion engines. More particularly, the invention provides a coating of a mechanical nature formed over portions of such liners which are normally in contact with corrosive coolant liquids normally found in circulating cooling systems employed in the removal of waste heat from diesel and other internal combustion engines, the coating being preferably formed from a polymerized polyester resin. The present invention provides protection against pitting due to cavitation-erosion, corrosion, and scale formation without the use of chromate, dichromate, inorganic condensed phosphate and organic corrosion inhibitors which are commonly added to coolant liquids.

2. Description of the Prior Art

Internal combustion engines and other apparatus which produce waste heat as a result of operation typically utilize cooling systems which circulate a liquid coolant in contact with portions of the engine or apparatus, heat exchange occurring between said portions and the liquid coolant. The liquid coolant in such systems usually comprises water, often in combination with a second coolant, such as ethylene glycol in amounts up to 15%. In internal combustion engines, particularly diesel engines, having "wet" cylinder blocks, a sleeve or liner separates the cylinder block from the liquid coolant. Typically, oil used in the operation of the engine is disposed on one side of the liner, the opposite side of the liner being in continuous contact with the liquid coolant, heat exchange occurring through the liner between the oil and the liquid coolant. It is well known that coolants, especially water, act to corrode such liners regardless of the metal from which the liner is fabricated. Pitting of such liners also occurs due to cavitation-erosion and other factors, the pitting finally resulting, if the linear is not replaced periodically, in the formation of pinholes which extend through the liner, the coolant liquid then contaminating the lubricant oil on the other side of the liner. An engine can be thereby caused to "seize" or be substantially damaged due to the resulting lack of proper lubrication. At best, the pitter liner must be replaced at substantial cost prior to a normally expected engine over-haul. Corrosion, scale, and other deposits further damage such liners and act to reduce the rate of heat transfer through the liner to the coolant liquid.

Since the above-noted problem is one of long standing in the art, a substantial amount of effort has been directed to a solution thereof. Primarily, the problem has been addressed in the prior art by the provision of chemical additives, such as chromates or dichromates which are dissolved in the coolant liquid, the substance frequency being employed in combination with inorganic condensed phosphates. Such substances are toxic and thereby cause environmental degradation when discharged after use. Certain additives act to form a substantially fluent, nonrigid film on the surfaces of the metallic liners in an effort to resist pitting and corrosion thereof. Since one of the mechanisms by which pitting occurs involves a mechanical bursting of air bubbles against the metal surface, such fluent films and coolant additives are not effective in the prevention of pitting of the surfaces of the liner in contact with the coolant liquid. Attempts have also been made to inhibit the corrosion of metallic surfaces by the formation of a protective metal oxide film. However, soluble species in the film act to migrate from the surface of the metal and are of no appreciable value to ionic and/or molecular corrodants or corrosion products, especially after a relatively short period of time. Degradation of such a metal oxide film results in a rapid corrosion rate due to the fact that dissolved oxygen in the aqueous environment which then contacts the metal surface diffuses to the free metal surface.

Mechanical filters have also been employed which have chemical substances disposed therein, the chemicals being intended to protect surfaces contacting the liquid from corrosion. However, the chemical substances in typical filters go into solution within 30 minutes, of installation of said filter within the cooling system. As with chemical additives of the type described above, loss of the coolant liquid due to boil-over or accidental drainage results in the complete loss of protection against corrosion and cavitation-erosion. Further, a filter in and of itself provides no protection against pitting of the cylinder block liner.

Given the present state of the art, it is obvious that improved protection against pitting and corrosion not only in "wet" sleeve internal combustion engines but also in apparatus having heat exchange surfaces in contact with a circulating liquid is needed.

SUMMARY OF THE INVENTION

The present invention particularly provides an improved article of manufacture which acts to mechanically protect a heat exchange surface against pitting and corrosion caused by contact therewith with a coolant liquid, particularly a circulating coolant liquid. The invention particularly comprehends the provision of a "wet" cylinder block liner, such as is commonly used in diesel engines, wherein portions of the liner are maintained in essentially continuous contact with a coolant liquid for heat exchange therewith. The invention acts to inhibit corrosion and to prevent pitting of metallic surfaces in heat exchange contact with cooling waters. The improved liner of the present invention acts to prevent pitting and corrosion of metallic surfaces thereof which would normally contact the coolant liquid, the improved liner maintaining adequate heat exchange to the coolant liquid. Essentially, the present invention contemplates the formation of a rigid, substantially non-deformable coating over at least those portions of a "wet" cylinder block liner which are in contact with a coolant liquid, the coating typically comprising a suitable polymeric material disposed over said portions and in intimate adhering contact therewith. The coating formed on the improved liner of the present invention is typically formed with a thickness of ½ to 1 micron, the thickness of the coating being of a dimension which minimally degrades the heat exchange capability of the improved liner relative to an uncoated liner. The mechanical coating of the invention can be applied to either new or used liners, the coating being applied to used liners retroactively during normal overhaul or repair of the engine. In either situation, the invention acts to increase the engine life expectancy of an internal combustion engine or to increase the life expectancy of heat exchange surfaces used in other apparatus which are subject to pitting and corrosion as aforesaid. The coating of the improved liner acts to prevent pitting and corrosion without the use of liquid coolant additives or regular maintenance, such as is required by the use of such additives and the use of filters, the coating not having to be regularly reapplied or repaired. Although the coating of the invention is resistant to scale information, water softening materials can be added to the coolant liquid as a further protection against scale formation on the coating itself. The use of the invention in internal combustion engines as aforesaid is not detrimental to the operation of or does not cause damage to other portions of such engines. The coating of the invention can be applied to a liner or other heat exchange component during manufacture of the liner or component, the coating maintaining pitting and corrosion resistant properties for an indefinite period of time even if not used, that is, a liner coated according to the present invention has an indefinite "shelf life".

According to the present invention, a barrier is created between the liquid coolant and the metallic surface of a "wet" cylinder block liner, which metallic surface would normally be in direct contact with the liquid coolant. The barrier acts to prevent contact between the liquid coolant and the metallic surfaces of the liner with maintenance of the heat exchange function provided by the liner. The invention can be described as a coating, layer, jacket, or other phrase which describes the nature of the thin coating which is provided over those portions of a heat exchanger surface in contact with a coolant liquid and subject thereby to corrosion and pitting due to cavitation-erosion inter alia. Although the invention will be described as providing an improved liner for "wet" cylinder block liners for internal combustion engines, particularly diesel engines, such an improved liner being a particularly useful application of the invention, it should be understood that heat exchange surfaces, particularly metallic surfaces, which are subject to pitting and corrosion as aforesaid fall within the scope of the present teachings, a coating according to the invention being disposable on heat exchange surfaces of apparatus other than that described particularly herein. The coating of the invention can also be applied to such heat exchange surfaces even after corrosion and/or pitting of the surface has occurred, the coating protecting the surface from further damage.

The coating of the invention is preferably formed of an oxidized polyester resin which can be applied manually or automatically in a fashion known in the art of coating a substrate with a polymeric material. For example, the present coating can be applied when the polymeric material is in a liquid state, the liner being rotated according to known spinning processes to provide a desired thickness of the polymeric material on the surfaces of the liner, the polymeric material being typically caused to harden due to catalytic or heat processing thereof either during or after the spinning of the liner. The coating itself is preferably formed of a polyester resin, such as is commercially available from the Koppers Company, Inc., Pittsburgh, Pa., and which contains inter alia a styrene monomer as a cross-linking agent and additive such as thixotropic agents and the like. The coating of the invention can typically be formed of the free radical polymerization product of a polyester resin using a catalyst such as methyl ethyl ketone peroxide in dimethyl phthalate or other stabilized catalyst which acts to initiate polymerization of the polyester resin. Polymeric materials, such as polyurethane, polystyrene, and other polymeric materials which are sufficiently polymerized to form a rigid coating which does not dimensionally degrade at the temperature encountered in the use environment and which is chemically resistant to common anti-freeze materials, such as ethylene glycol, can be used to form the "barrier" layer or jacket of the invention over those portions of a cylinder liner or heat exchange surface which is in contact with a liquid coolant as aforesaid. The present coating provides a mechanical barrier formed of a polymeric material, particularly a synthetic polyester resin, which is resistant to deformation and degradation due to thermal loading. It is to be understood that the coating provided by the improved liner of the invention can be formed by a polymeric material which can be cast or otherwise disposed over the portions of the liner which are to be protected against corrosion and pitting, the coating conforming to the shape of and adhering to said surfaces to form a rigid mechanical barrier, the polymeric material preferably comprising, but not being limited to, the reaction product of a free radical oxidatively coupled polyester resin.

Accordingly, it is an object of the invention to provide an improved heat exchange article of manufacture, particularly a liner for a "wet" sleeve internal combustion engine, which is not subject to pitting and corrosion.

It is another object of the invention to provide a coating on a "wet" cylinder block liner of an internal combustion engine over surface portions of said liner which are normally in contact with a circulating coolant liquid, the coating acting to prevent corrosion and pitting of said surfaces thereby coated.

It is a further object of the invention to provide a coating formed of a polymerized material, the coating being rigid, resistant to thermal loading and chemical attack, and which conforms to and adheres to the surfaces of a "wet" cylinder block liner of an internal combustion engine which are normally in contact with a circulating coolant liquid.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
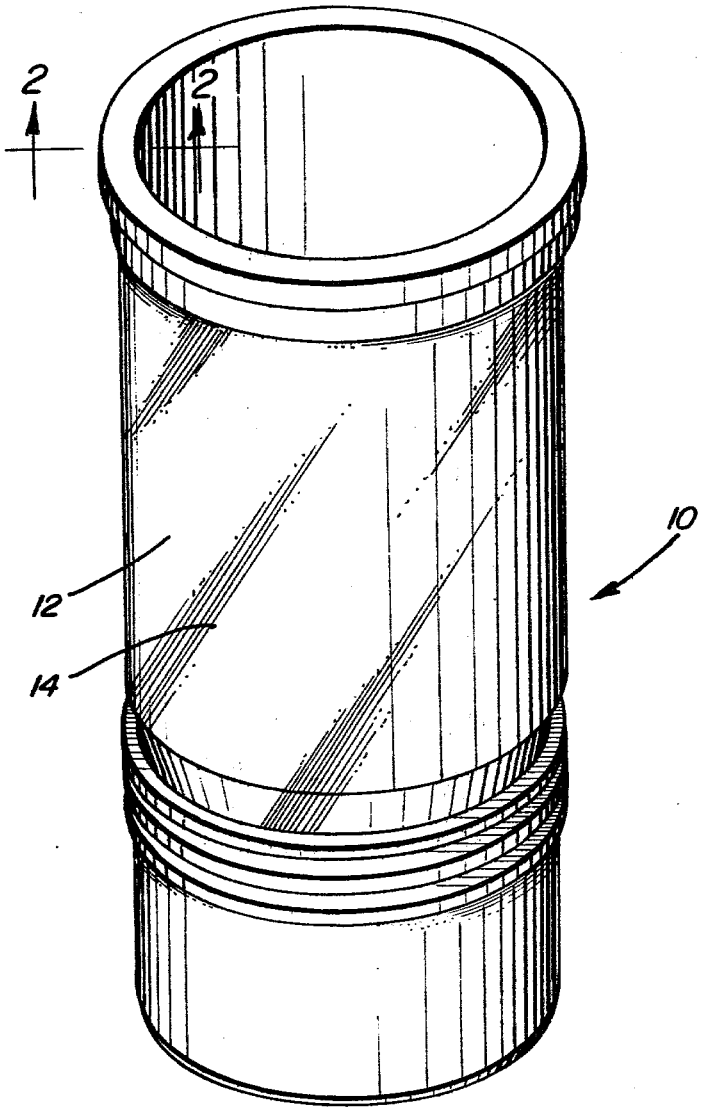
FIG. 1 is a perspective view of a typical "wet" sleeve used in a four cycle diesel engine, those portions of the sleeve which are normally in direct contact with a coolant liquid being provided with a coating according to the invention; and, FIG. 2 is a sectional view taken along line 2—2 of FIG. 1.
Figure 2:
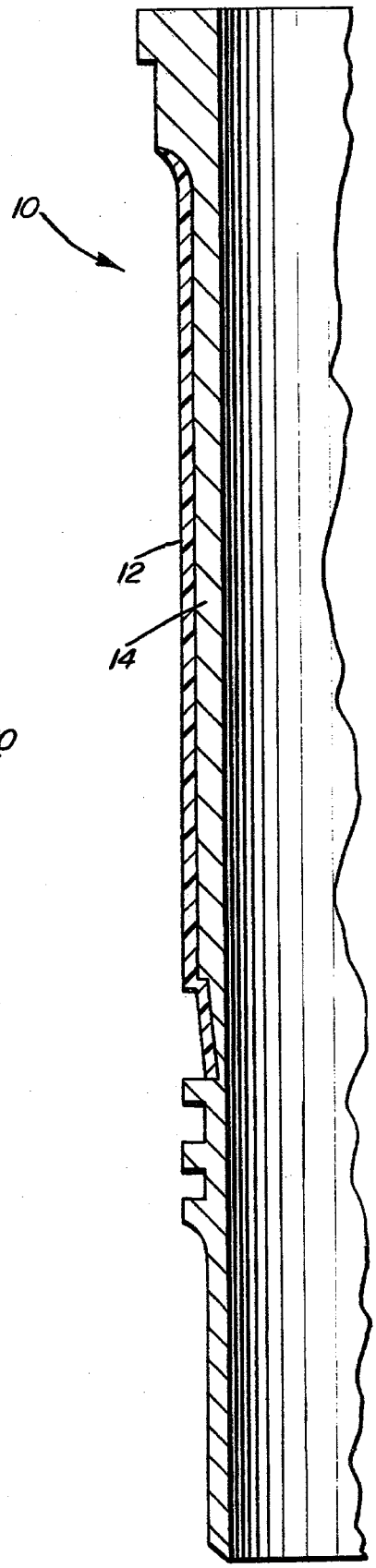

Referring to the drawings, a sleeve 10 is shown, the sleeve 10 being the well known sleeve or liner structure which comprises a portion of a diesel engine manufactured by the Cummins Corporation. The sleeve 10 as shown in the drawings comprises a portion of a typical four-cycle engine of the "wet" cylinder type, certain surface portions of the sleeve 10, those portions designated by the numeral 14, normally being in direct contact with a coolant liquid which is circulating through the Diesel engine of which the sleeve 10 is one component part. The surface portions 14 are provided with a coating 12 formed thereover, the surface portions 14 previously being subject to pitting and corrosion as aforesaid due to direct contact with the coolant liquid. The coating 12 forms a barrier between the coolant liquid and the surface portions 14 of the sleeve 10, the coating 12 conforming and adhering to said portions 14. As particularly seen in FIG. 1, the coating 12 forms a "jacket" about central portions of the sleeve 10, the coating 12 providing a mechanical barrier which protects the portions 14, which portions 14 are comprised of metal, from chemical attack, corrosion, cavitation-erosion, or other mechanisms which would cause the portions 14 to be corroded or pitted to the point of forming pinholes therein and thereby causing substantial damage to the engine of which the sleeve 10 forms a portion. While the invention finds particular utility as an improved liner for internal combustion engines, it is to be understood that the coating 12 could be applied to other heat exchange surfaces which are subject to pitting and corrosion due to contact with a corrosive liquid, such as a coolant liquid. It is also to be understood that the coating 12 is shown in the drawings as being of a thickness which is substantially greater relative to the thickness of the walls of the sleeve 10 for purposes of illustration. The coating 12 will typically be formed with a thickness of ½ to 1 micron, especially when heat exchange through the coated metal is necessary due to the usual functioning of the structure. For example, the sleeve 10 typically has heat exchanged therethrough from interiorly of sleeve 10 to a liquid coolant which circulates externally of the sleeve 10 and which would normally be in direct contact with the surfaces of the portions 14. In order to allow adequate heat exchange through the sleeve 10, the coating 12 must be formed of a dimension which allows relatively unimpeded heat exchange therethrough. Metallic surfaces which normally must be in contact with a corrosive coolant or other corrosive liquid and which are not required to conduct heat therethrough to any substantial degree can be formed with a coating of a greater thickness than that described relative to the sleeve 10.

The coating 12 is preferably formed of an oxidized polyester resin, such as the polyester resin commercially available from the Koppers Company, Inc., which polyester resin typically contains inter alia styrene monomer and additives such as thixotropic agents. The oxidized polyester resin is preferably the polymerization product of an oxidatively coupling reaction which is initiated by a free radical catalyst, particularly methyl ethyl ketone peroxide in dimethyl phthalate or other stabilized catalyst, including benzoyl peroxide.

Polyester resins vary widely in composition and are typically defined as thermosetting synthetic resins which are polycondensation products of dicarboxylic acids with dihydroxy alcohols, thereby being a particular type of alkyd resin which are not usually modified with fatty acids or drying oils. Polyester resins, when catalyzed, can cure or harden at room temperature under little or no pressure, thereby rendering the use thereof in the present invention more convenient due to the fact that the coating 12 can be spin cast or manually applied to a sleeve 10 in a desired thickness, the thickness being controllable to a finite degree by available techniques in the art. Polyester resins useful in the invention typically contain ethylenic unsaturation, the unsaturated polyester resins being usually cross-linked through the double bonds therein with a compatible monomer, such as styrene monomer, the monomer typically containing ethylenic unsaturation. Typical unsaturated acids used in the preparation of polyester resins are maleic and fumaric acids, saturated acids such as phthalic and adipic acids also being potentially included to reduce the amount of unsaturation in the final resin. Acid anhydrides may also be used as is known in the art. The dihydroxy alcohols most generally used are ethylene, propylene, diethylene and dipropylene glycols. The polymerized product of polyester resins are particularly suited to use with the present invention due to the fact that the resins are resistant to corrosion, chemicals, solvents, and can be employed to form brittle, rigid coatings which adhere to metallic surfaces.

Other polymeric materials useful for forming the coating 12 are polystyrene, polyurethane, epoxy resins, and other addition or condensation polymers, which can be polymerized to the degree necessary to form a hardened coating which conforms and adheres to surface portions of a heat exchange structure which are normally in contact with a corrosive coolant, such as the portions 14 of the sleeve 10. Even though such polymeric coatings are typically considered to be heat insulative, the thinness of the coating which can be usefully employed as a protection against corrosion and pitting provides minimal insulation against heat transfer through the coated heat exchange structure, such as the portions 14 of the sleeve 10 covered by the coating 12. As aforesaid, in the improved liner of the present invention having the coating 12, a thickness of the coating 12 of ½ to 1 micron proves adequate for protection of the sleeve 10 while allowing adequate heat transfer through the sleeve 10. The coating 12 can be extended to surface portions of the sleeve 10 immediately adjacent to those portions 14 of the sleeve 10 which would normally be in direct contact with the liquid coolant, it being possible to provide portions of the coating 12 over a water seal groove or a metal step-up in the sleeve 10. The coating 12 can also be formed of an acrylic resin, such a resin being a thermoplastic polymer or copolymer of acrylic acid, methacrylic acid, esters of said acids, or acrylonitrile, the monomers polymerizing readily in the presence of catalysts such as benzoyl peroxide, a product which is commercially available from the Lucidol Corporation under the trade name of Lucidol. Polymers formed of acrylic resins typically exhibit shock resistance and stability against chemical attack, the rigid brittle polymeric materials commercially known as Lucite and Plexiglas, trade names of the DuPont Corporation, being also usable to form the coating 12 of the invention.

The coating 12 acts as a complete barrier to corrosion and pitting of the surfaces of the sleeve 10 which would normally be in contact with a coolant liquid, the coating 12 not interfering with the operation of the internal combustion engine of which the sleeve 10 forms a portion. Further, the coating 12, particularly when formed with a polyester resin as aforesaid, is resistant to attack and is compatible with water softeners, antifreeze materials, and other coolant preparations which could be added to the coolant system of the internal combustion engine.

When the polymeric material used to form coating 12 is a free radical initiated polymerization product, particularly a polymer formed of polyester resins, a particularly suitable catalyst comprises methyl ethyl ketone peroxide in dimethyl phthalate, such as is described in U.S. Pat. No. 3,380,871, which patent is incorporated hereinto by reference. As an example of the invention, a sleeve 10 such as is used in a Cummins four cycle diesel engine was provided with a coating 12 formed of the free radical polymerization product of polyester resin using methyl ethyl ketone peroxide in dimethyl phthalate as the stabilized catalyst, the polyester resin being that resin commercially available from the Koppers Company, Inc., and which contains inter alia styrene polymer. Although the sleeve so coated was used in a four cycle engine, it is to be understood that sleeves from two cycle diesel engines as well as other internal combustion engines wherein a cylinder block sleeve or liner is disposed in contact with a coolant liquid can also be provided with a coating according to the invention. The Cummins sleeves so coated were both new and used sleeves, certain of the used sleeves already having pitting of surface portions such as the portions 14, pinholes not yet having formed. The new and used sleeves coated according to the invention were installed in a "wet" type Cummins four cycle diesel engine and operated therein beyond the typical life expectancy of a new liner. In all instances, pinholes did not develop in the surfaces of the liner, the liners only being removed due to normal piston cycle wear. In the example cited, no rust inhibitors or corrosion inhibitors of any type were employed in the coolant, only an antifreeze product being employed in one of the new engines during the use thereof. After so testing, the coatings 12 were found to be intact, no cracks having developed in the coating. It is, therefore, apparent that the coating 12 provides permanent and total protection for a "wet" sleeve which is sufficient to last for the expected life of the sleeve and acts to prevent corrosion and pitting of the sleeve without the need for continuing maintenance of the sleeve or the use of rust inhibitors, rust preventatives, or corrosion inhibitors in the coolant liquid which is used in the engine.

From the foregoing, it is apparent that the coating 12 can be formed of a polymeric material capable of forming a rigid "jacket" over selected portions 14 of the sleeve 10, the coating 12 being resistant to thermal deformation at the operating temperature of the apparatus in which the coating 12 is used. Further, the coating 12 is formed of a polymeric material which is unreactive after curing to substances typically present in the coolant liquid, particularly ethylene glycol. The mechanical properties of such a coating 12, particularly a coating 12 formed of polystyrene, would at a minimum typically be as follows:

Tensile strength (psi): 5,000
Compressive strength (psi): 10,000
Flexural strength (psi): 8,000
Modulus of elasticity, tension (psi): $4\times10^5$
Impact strength (Izod, ft. lb./in. notch): 0.25
Rockwell hardness: M65
Shear strength (psi): 6,000.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In an internal combustion engine having a liquid coolant normally in contact with a liner of a cylinder, an improved liner comprising:

a rigid, thermally resistant, brittle coating which adheres to metallic surfaces, directly disposed on the liner over at least those surface portions thereof which would normally contact the liquid coolant, the coating consisting of a single layer of polymeric material selected from the group consisting of polystyrene, polymerized polyester resin, polyurethane, and polymerized epoxy resin, polymerized to form a hardened coating which conforms and adheres to said surface portions of the liner, wherein the coating is unreactive to a coolant liquid selected from the group consisting of water, ethylene glycol, and mixtures thereof, and wherein the coating has a thickness of about ½ to 1 micron so as to permit relatively unimpeded heat exchange therethrough.

2. The improved liner of claim 1, wherein the coating is the oxidized polymerization product of a polyester resin catalyzed by methyl ethyl ketone peroxide in dimethyl phthalate and cross-linked by styrene monomer.

3. The improved liner of claim 1, wherein the coating is the oxidized free radical-initiated polymerization product of polyester resin.

4. The improved liner of claim 1, wherein the coating is a rigid brittle acrylic resin polymer or copolymer of monomers selected from the group consisting of acrylic acid, methacrylic acid, esters of acrylic acid, esters of methacrylic acid, acrylonite, and mixtures thereof, whereby the coating exhibits shock resistance and stability against chemical attack.

5. The improved liner of claim 1, wherein the coating is polystyrene has a Rockwell hardness of about M65 and a modulus of elasticity, tension, of about 400,000 psi.

* * * * *